US005222670A

United States Patent [19]

Huang

[11] Patent Number: 5,222,670

[45] Date of Patent: Jun. 29, 1993

[54] BATTERY PACK ADAPTER

[75] Inventor: Chin J. Huang, Taipei Hsien, Taiwan

[73] Assignee: Londa Photo Products Co., Ltd., Taipei Hsien, Taiwan

[21] Appl. No.: 789,029

[22] Filed: Nov. 7, 1991

[51] Int. Cl.[5] ..... H01R 27/00

[52] U.S. Cl. ..... 439/222; 354/126; 354/288; 439/174

[58] Field of Search ..... 439/131, 500, 171-174, 439/217, 218, 222, 221, 223, 224; 358/906; 354/126, 288, 295, 173.1, 202

[56] References Cited

U.S. PATENT DOCUMENTS

| | | | |
|---|---|---|---|
| 4,110,770 | 8/1978 | Lange | 354/126 X |
| 4,375,308 | 3/1983 | Wilkinson | 439/171 X |
| 4,543,624 | 9/1985 | Rumble | 439/173 X |
| 4,924,246 | 5/1990 | Yamada | 354/126 |
| 5,068,683 | 11/1991 | Miyazaki | 358/906 X |
| 5,075,706 | 12/1991 | Miyazaki | 354/126 |
| 5,095,408 | 3/1992 | Chen | 354/126 X |

*Primary Examiner*—Larry I. Schwartz
*Assistant Examiner*—Kevin J. Carroll
*Attorney, Agent, or Firm*—Jacobson, Price, Holman & Stern

[57] ABSTRACT

An adapter is disclosed to enable battery packs constructed for unique attachment to different kinds of video cameras to be attached interchangeably to the respective cameras. The adapter has a front seating surface which attaches to the seating surface of the respective camera and a back seating surface to attach to the respective battery pack. On the front seating surface the adapter has contact plates configured to make contact with differently positioned contact pins of the respective cameras and separate catch recesses for receiving the respective retractable catches on the different cameras. The rear seating surface has selectively usable pairs of retractable contact pins and a switch for selectively moving the pins in and out of the adapter. The respective pairs of pins are to engage differently positioned electrical contact plates on the respective battery packs. The adapter also has a movable side catch for locking the respective battery pack in place. Further, the adapter may also have a socket for receiving an electrical charger for charging the battery pack when attached to the adapter.

5 Claims, 8 Drawing Sheets

BATTERY PACK ADAPTER

BACKGROUND OF THE INVENTION

This invention relates to a battery pack adapter particularly to enable a battery pack designed for use on one brand of video camera to be used on another brand of video camera. There are many brands of video cameras on the market, such as SONY, JVC or Panasonic brands and each individual manufacturer makes a somewhat different design of camera. Except that video tapes in general use (for example VS, VHS-C, etc.) have common specifications, the other components or parts of the respective camera systems differ from one another especially insofar as the loading and plugging structure for the camera battery pack are concerned, and each manufacturer has its own specifications for the battery pack.

For example, FIG. 1 shows a SONY brand of camera A and associated battery pack B. The back face of the camera defines a battery pack seat which, towards its base is provided with two projecting conductive rods Al adjacent to each other. Beside the rods is a retractable catch A2 operated by a push button A4, while the top and bottom edges of the battery seat are respectively equipped with fixed catches A3. Correspondingly, the front surface of the battery pack B has conductive terminals B1 for making electrical connection with the rods Al, an adjacent reception aperture B2 for the catch A2 and female plug-in connections B3 at the top and bottom for the catches A3 for attachment and release of the battery pack by a bayonet type of interaction of catches A3 and B3. The catch A2 is retracted by means of the button A4 and when the button A4 is released, catch A2 engages in aperture B2 to lock the battery pack in place. To remove the battery pack, it is necessary to retract catch A2.

FIG. 2 shows a Panasonic camera C and battery pack D. The back of the Panasonic camera is again formed as a seat for the battery pack and has two pairs of spaced conductive rods Cl adapted to engage terminals D1 in the battery pack. Spaced upwardly from the rods Cl is a retractable catch C2 operated by a push button C4. Again, the camera is provided with upper and lower fixed catches C3 and the battery pack has corresponding bayonet type receiving formations D3. It will be understood that the battery pack is attached to and removed from the camera in like manner to the SONY battery pack previously described but the location, and spacing of the various catches, rods, and terminals is different for the two systems. Accordingly, the SONY battery pack cannot be used on the Panasonic camera and likewise the Panasonic battery pack cannot be used on the SONY camera.

Moreover, since the different brands of battery packs have different specifications, there are also dissimilar battery chargers for the different cameras. Thus, should a user purchase the wrong type of charger he cannot use it on a particular camera and if the user has two or more different kinds of cameras, different battery chargers are required.

SUMMARY OF THE INVENTION

The invention provides a universal-type adapter which can be fitted to the battery pack-receiving seat of various kinds of video cameras and which itself can be used as a seat to mount different kinds of battery packs. Accordingly, by use of the adapter, a battery pack designed for one brand of camera can be used on another brand of camera. Additionally, the adapter may include a charging connector suitable for use for various different types of chargers so that when the adapter is linked up with a battery pack it ca also be used to charge the battery pack either when attached to or detached from a camera.

In more detail, the adapter has a front surface for mounting on the camera seat which includes terminals dimensioned to accommodate the projecting rods of various cameras and on the back face of the adapter, used a seat for different battery packs, the adapter includes selectively usable pairs of projecting rods, controlled by a switch which can be selectively used to make the adapter suitable to fit the terminals of different battery packs.

The adapter also has a sliding catch at one side for releasably securing the respective battery pack.

DESCRIPTION OF PREFERRED EMBODIMENT

Figure 1:
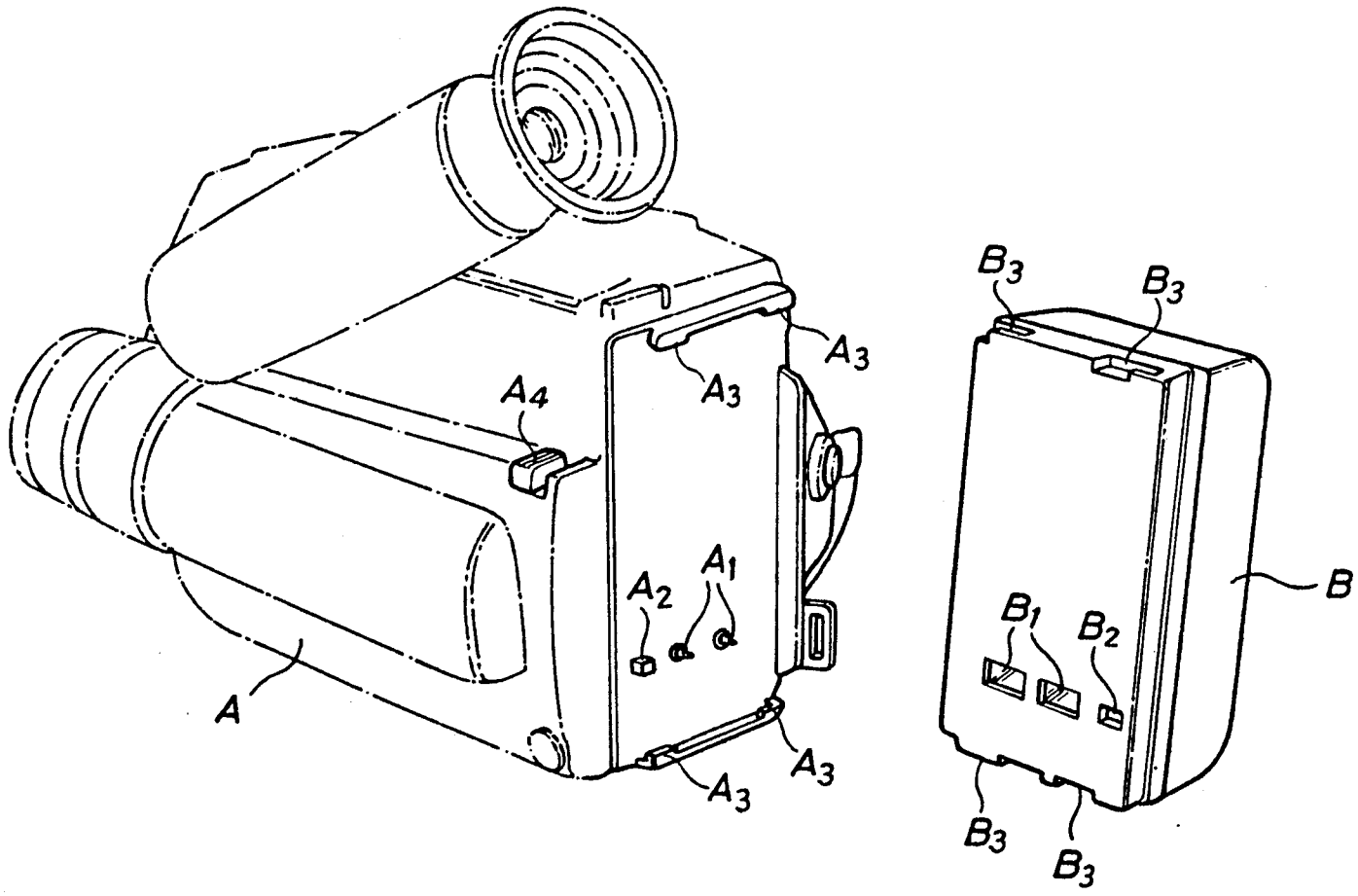
FIG. 1 (PRIOR ART)
FIG. 1 is a perspective view of one form of video camera and associated battery pack.
Figure 2:
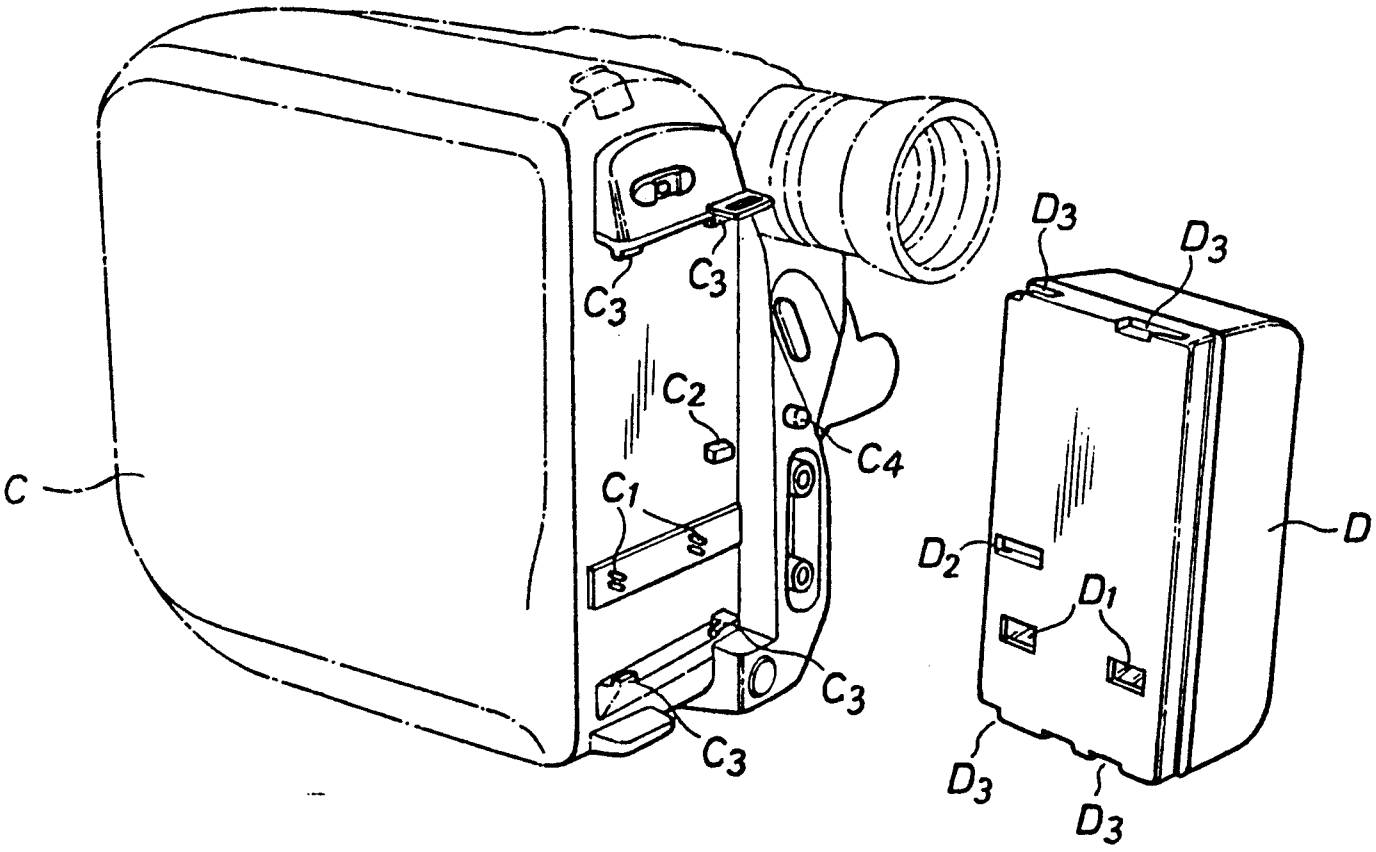
FIG. 2 (PRIOR ART)
FIG. 2 is a view similar to FIG. 1 of a second form of video camera and battery pack.
Figure 4:
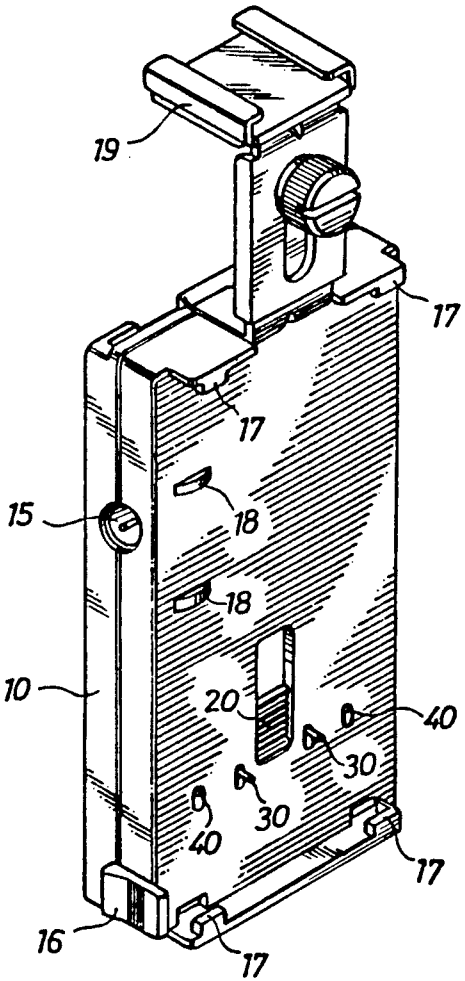
FIG. 4 is a perspective view from the back of the battery pack adapter.
Figure 3:
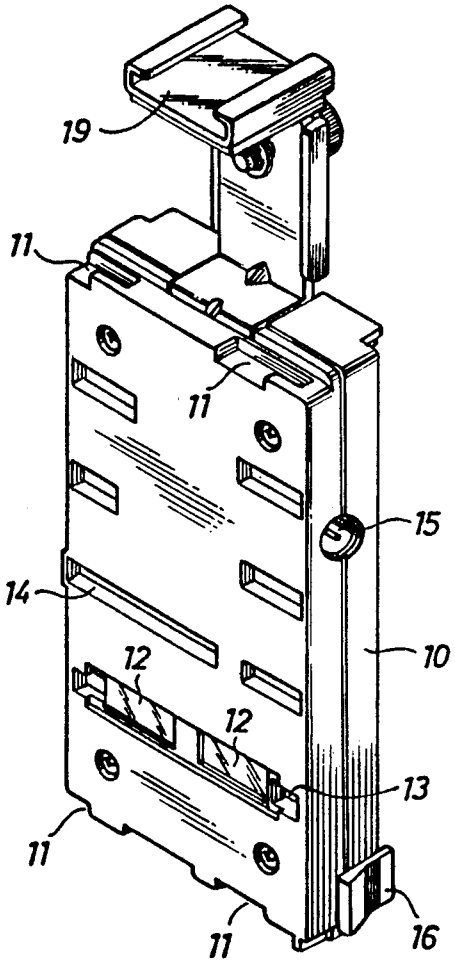
FIG. 3 is a perspective view from the front of a battery pack adapter according to the invention.

Referring initially to FIGS. 3 and 4, there is shown a battery pack adapter 10 for use on different video cameras, such as the cameras previously referred in connection with FIGS. 1 and 2. The adapter 10 has a front seating face formed on its upper and lower edges with recesses 11 adapted to receive the fixed catches A3 or C3 on the respective cameras A and C (FIGS. 1 and 2) such catches at least having a standard spacing and configuration. Adjacent the lower end of the front seating face the adapter is provided with conductive terminal plates 12 of sufficient width and height so as to receive either the conductive pins Al of camera A or the conductive pins Cl of camera C. To one side of the plate 12 is a recess 13 for receiving the retractable catch A2 of camera A and above the plates 12 there is a further recess 14 for receiving the catch C2 of camera C. Further recesses similar to recess 14 are also provided for the attractable catches of non-illustrated brands of cameras.

On one side of the adapter there is provided a socket connector 15 for receipt of a battery charger and at the bottom of the side face there is a rearwardly sprung catch 16.

As shown in FIG. 4, the rear seating face of adapter 10 has upper and lower fixed male catches 17 for receipt in the respective recesses B3 or D3 of the battery packs B and D. The rear seating face further has vertically spaced projections 18. On the top of the adapter there ma be provided an extending bracket 19 for flashlight or the like. Toward the lower end of the rear seating face there is a sliding switch element 20 for selectively projecting pairs of conductive pins 30 and 40 respectively from the rear seating face as will be described. The more closely spaced pair of pins 30 are, for example, for use in making electrical connection with the terminal plates B1 of battery pack B and the more widely spaced pair of pins 40 is for making electrical connection with the terminal plates D of battery pack D.

Figure 5:
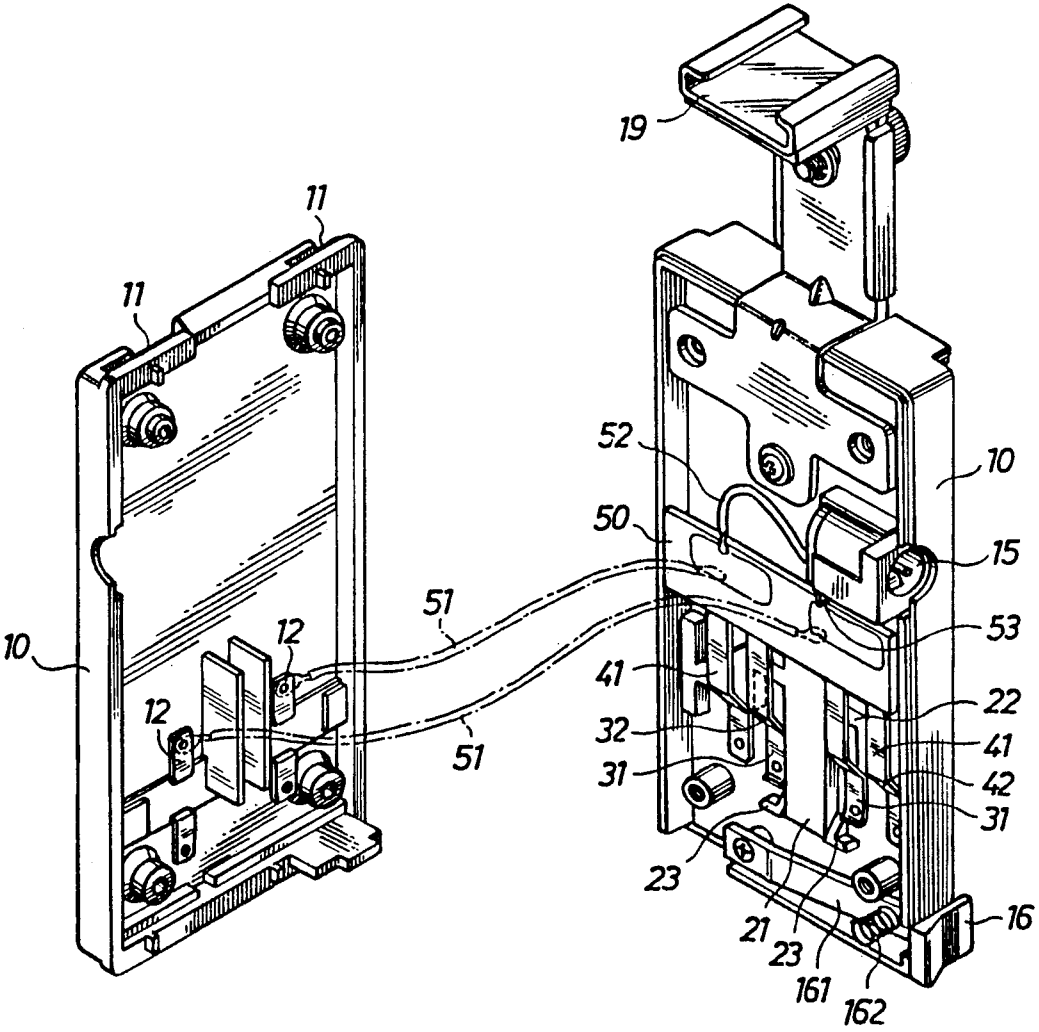
FIG. 5 is an exploded perspective view of the battery pack adapter.
Figure 7:
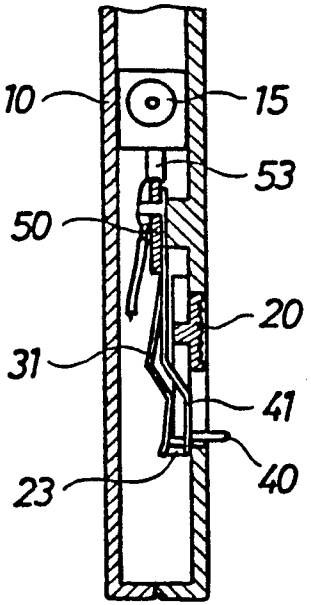
FIG. 7 is a view similar to FIG. 6 in a second switching position.
Figure 6:
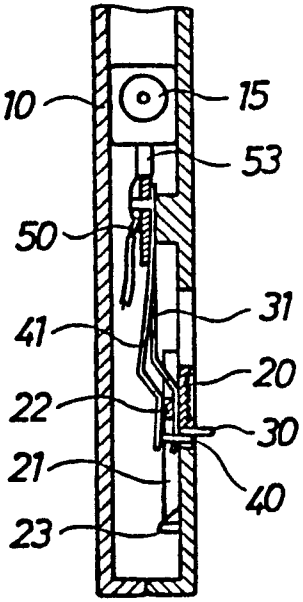
FIG. 6 is a sectional elevational view part broken away of the battery pack adapter in a first switching position.

The internal structure of the adapter is shown in more detail in FIGS. 5–7. Referring firstly to FIG. 5, internally the adapter includes a PC board 50 electrically connected with the terminal plates 12 through conductors 51, with the charging socket 15 through conductor 52 and with the pins 30 and 40 through respective conductive sheets or legs 31, 41 welded or riveted at their top ends to the PC board and at their bottom ends to the respective pins. It will be seen that the respective legs 31, 41 are bent substantially centrally of their length and have oblique surfaces 32, 42 connecting the upper portion of each leg with the respective lower portion. The movable switch element 20 is effective to project the pins 30 from the rear seating face of the adapter while the pins 40 are retracted or to project the pins 40 from the adapter while the pins 30 are retracted, such operations being effected, as will be described below, through interaction of the switch with the respective legs 3 and 41.

Internally of the adapter, as shown in FIG. 5, the switch member 20 carries a vertical bar or rod 21 having at its lower end flanges 23 with oblique surfaces adapted for engagement with the respective legs 31. Higher up the bar 2? are lateral projections 22 which are shaped to extend through the clearances in the upper parts of legs 31 and to engage with the respective legs 42.

When the switch member 20 is in a intermediate position the flanges 23 are below the bottom ends of legs 31 and the projections 22 are within the clearances provided by the upper ends of legs 41. Accordingly, both sets of pins 30 and 40 will be projected through the back surface of the adapter. When the switch element 20 is moved to a lower position, as shown in FIG. 6, the projections 22 ride along the oblique surfaces 42 of legs 41 thereby retracting the pins 40 within the adapter as shown in FIG. 6, while the pins 30 remain projected. Alternatively, when the switch element 20 is raised from its intermediate position, as shown in FIG. 7, the oblique surfaces of flanges 23 engage the legs 31 and cause the pins 30 to be withdrawn into the adapter while the pins 40 remain projected with the projections 22 remaining within the clearance areas of the legs 42. Accordingly, by suitable positioning of the switch element 20 either set of pins 30 or 40 can be projected from the adapter for use of a respective one of the battery packs to make electrical connection, through the PC board 50 with the terminal plates 12.

The movable catch 16 is pivotally connected at the base of the adapter fore and aft movement by means of lever arm 161 urged rearwardly by a spring 162 engaging an inner wall of the adapter. Thus, the catch 16 is urged to project from the rear seating face of the adapter but can be moved forwardly by hand against a spring action in order to attach a battery pack to the rear seating face.

Figure 8:
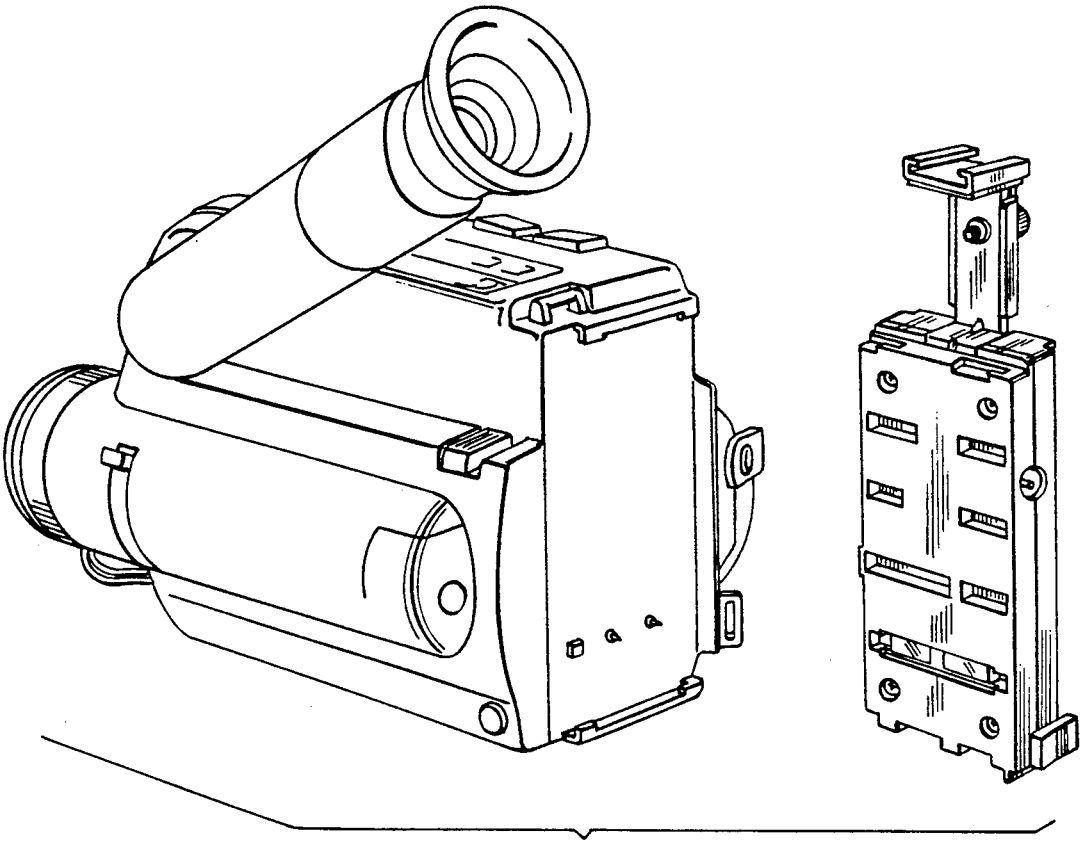
FIG. 8 is a perspective view of the first form of video camera and detached adapter.
Figure 9:
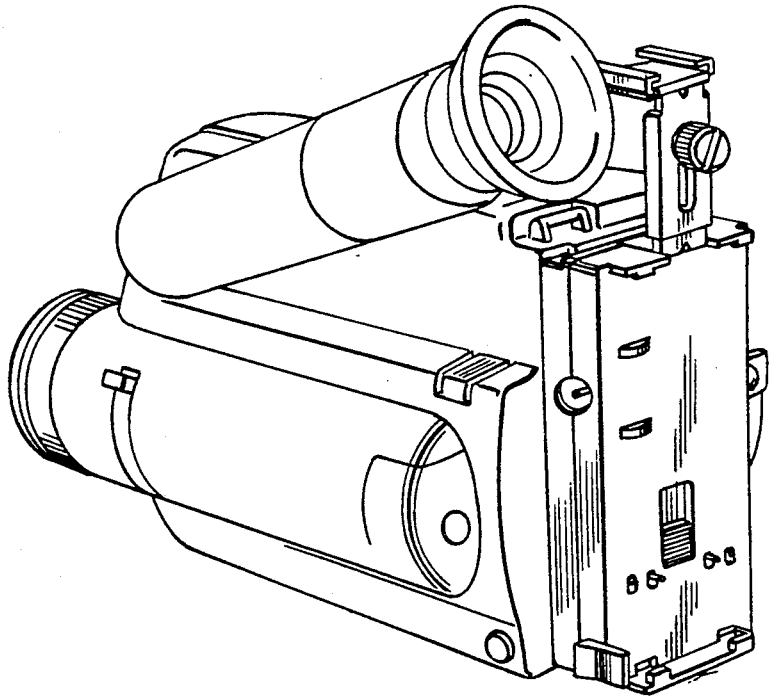
FIG. 9 is a view similar to FIG. 8 with the adapter attached to the camera.
Figure 10:
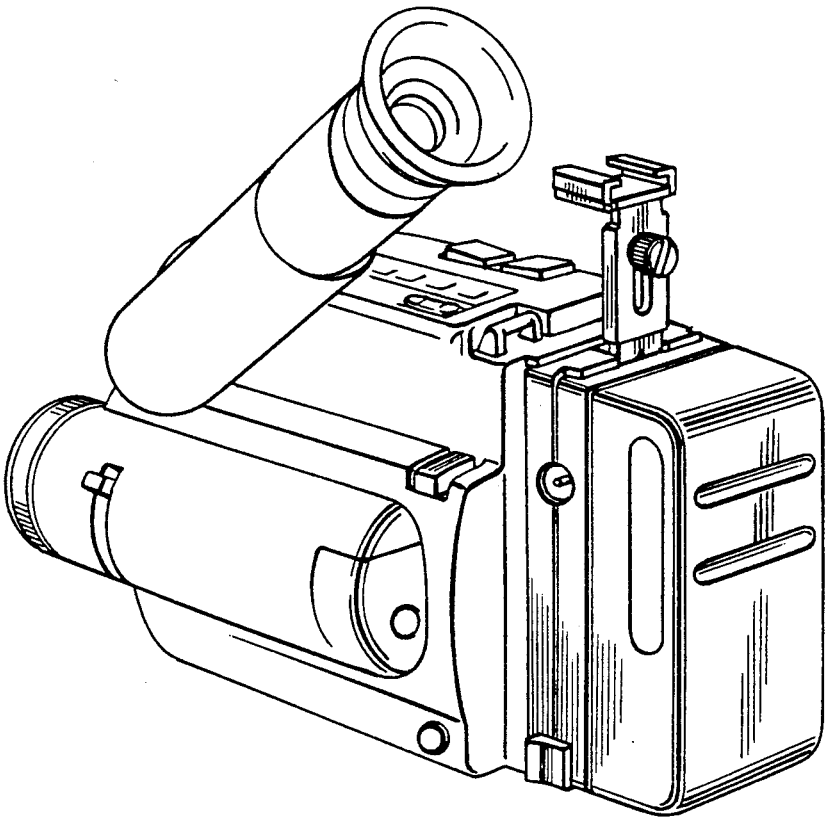
FIG. 10 is view similar to FIG. 9 with the second form of battery pack attached to the adapter.

To use a Panasonic-type battery pack D on a SONY video camera, as shown in FIGS. 8–10, firstly, the adapter 10 is attached to the video camera using the push button A4 and retractable catch A2 to engage in the aperture 13 on the front seating face of the adapter and with the conductive pins A1 engaging the terminal plates 12. The switch element 20 is moved into the elevated position shown in FIG. 7 where the pins 30 are retracted into the adapter and the pins 40 are projected from the adapter to fit the terminal plates D1 of the Panasonic type battery pack. Then, the battery pack D can be attached to the adapter by engaging the fixed catches 17 of the adapter in the recesses D3 of the battery pack. To effect such connection, the movable adapter catch 16 must be moved forwardly and then released to lock the battery pack firmly in place.

Figure 13:
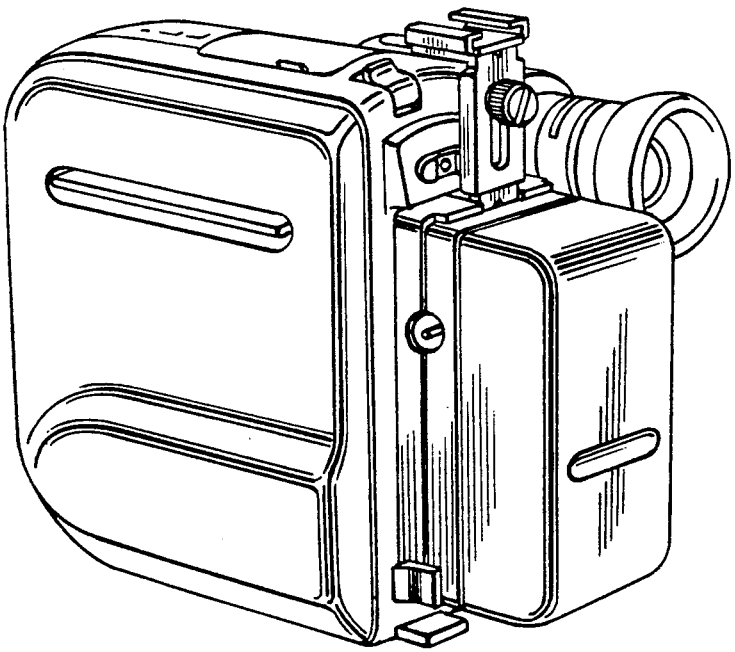
FIG. 13 is a view similar to FIG. 12 with the first form of battery pack attached to the adapter.
Figure 11:
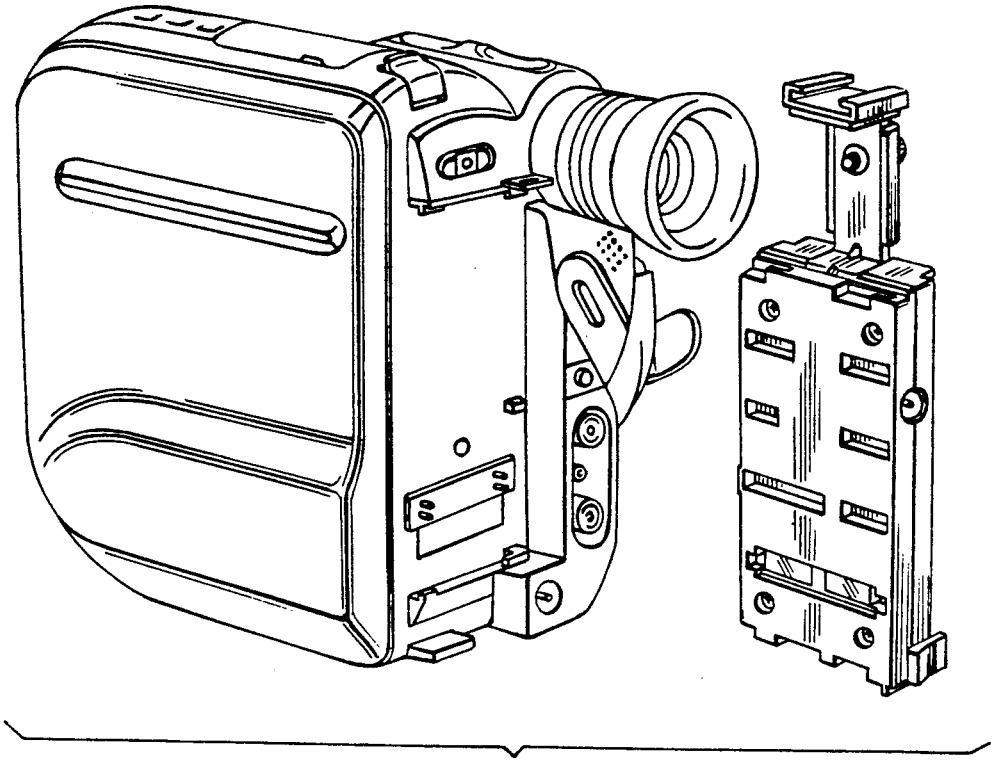
FIG. 11 is a perspective view of the second form of video camera and detached adapter.
Figure 12:
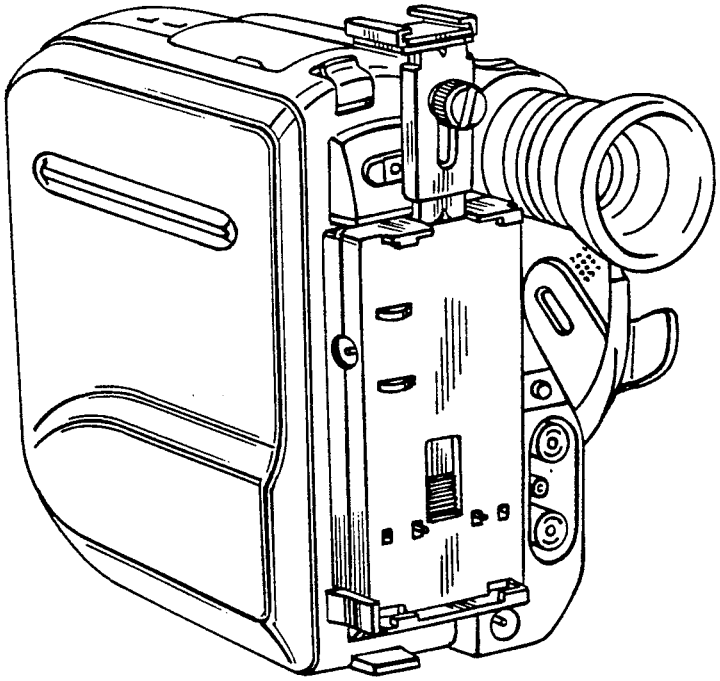
FIG. 12 is a view similar to FIG. 11 with the adapter attached to the camera.

Similarly, to attach a SONY-type battery pack B to a Panasonic video camera C as shown in FIGS. 11–13, first the adapter 10 is attached to the camera using push button C4 and catch C2 to engage in the recess 14 of the battery pack and with conductive pins Cl engaging the terminal plates 12 as previously. The switch element 20 is moved to its lower position as shown in FIG. 6, where the conductive pins 40 are withdrawn into the adapter and the more closely spaced pins 30 are projected from the adapter to engage the respective terminal plates B1 of the SONY-type battery pack. This battery pack B, can then be attached to the adapter, again using the fixed catches 17 and the movable catch 16 as previously.

The socket 15 can be used to charge either battery pack B or D when attached to the adapter either on or off a respective camera.

The inventive adapter is useful for attaching the following brand of battery packs to the following brands of cameras interchangeably.

| | | | |
|---|---|---|---|
| SONY Brand: | CCD-TR45 | Panasonic Brand: | PV-10 |
| | CCD-TR55 | | PV-20 |
| | CCD-TR75 | | PC-40 |
| Victor Brand: | GR-LT5 | | NV-S1 |
| JVC Brand: | GR-AX7 | KYOCERA Brand: | KX-1 |
| | GR-AX7E | | KX-70 |
| FUJI Brand: | M690 | | KX-90 |
| | M660 | NIKON Brand: | VN-3000 |
| | M890 | | VN-5000 |
| RICOH Brand: | R680 | GRUNDIG Brand: | VS8320 |
| | R66 | | VS8300 |
| | R86S | | VS-C55 |
| YASHICA Brand: | KX-90E | BAUER Brand: | C61 |
| SANYO Brand: | VM-ES88 | | C81 |
| MINOLTA Brand: | C-606E | METZ Brand: | Meca-vision |
| | C-406E | | 9702 |

When the adapter according to the invention is to be used as a battery charger for one of the battery packs, this can be done either on or off a respective camera. The battery pack will be attached in the manner previously described by suitable use of the switch 20 and a plug of rectifier is suitably inserted in the socket 15. While only a preferred embodiment of the invention is being described herein in detail, the invention is not limited thereby and modifications can be made within the scope of the attached claims.

I claim:

1. An adapter to enable battery packs each constructed for attachment uniquely to a different kind of video camera to be attached interchangeably to the respective cameras, each of said cameras having a first seating surface with fixed upper and lower catches, projecting electrical contact pins and a push-button controlled retracting catch, each of said battery packs having a second seating surface with upper and lower recesses for receiving the fixed upper and lower catches, electrical terminal plates positioned to make contact with the contact pins of a respective camera, and a catch recess for receiving the retracting catch of the respective camera, wherein the contact pins and retracting catches of the respective cameras are located in different positions on the respective first seating surfaces, and the terminal plates and catch recesses are correspondingly located in different positions on the respective second seating surfaces, the adapter comprising a casing having a TM front seating surface for attachment to any one of said cameras and a back seating surface for attachment of any one of said battery packs, the front seating surface having upper and lower recesses for receiving the fixed upper and lower catches of any one of the cameras, electrical terminal plates positioned and configured to make contact with the contact pins of any one of said cameras and a plurality of catch recesses positioned to receive the respective retracting catches of the respective cameras, the rear seating surface having fixed upper and lower catches for engaging in the upper and lower recesses of any one of the battery packs, plural pairs of contact pins selectively retractable into and extendable from the adapter to engage with respective differently located terminal plates of the respective battery packs, and manually operable switch means for selectively extending and retracting the respective pairs of contact pins, the adapter further including electrical circuit means connecting the terminal plates of the adapter to each pair of contact pins of the adapter and a movable catch for locking a battery pack in place on the rear seating surface.

2. An adapter as claimed in claim 1 wherein the movable catch is located on a side face of the adapter and the adapter includes spring means urging the movable catch to a position projecting from the rear seating surface of the adapter.

3. An adapter as claimed in claim 1 wherein the circuit means includes receiver means for a battery charger for charging batteries in an attached battery pack through a respective pair of said contact pins of the adapter.

4. An adapter as claimed in claim 1 wherein the contact pins of the adapter are carried on respective legs depending from a circuit board forming part of said circuit means and the manually operable switch means includes a movable switch member for selectively moving respective pairs of said legs to extend and retract the respective pair of pins.

5. An adapter as claimed in claim 4 wherein the legs include an inner pair of legs and an outer pair of legs, and the switch member includes a vertical rod between the inner pair of legs with upper and lower transversely extending leg actuators the lower leg actuators operating on the inner pair of legs and the upper actuators operating on the outer pair of legs, the switch member having a lower position wherein the lower actuators clear the inner pair of legs so that the associated contact pins extend from the adapter while the upper actuators engage the outer pair of legs withdrawing the associated pins into the adapter, the switch member having an upper position wherein the upper actuators clear the outer pair of legs so that the associated contact pins extend from the adapter while the lower actuators engage the inner pair of legs withdrawing the associated pins into the adapter.

* * * * *